US006568801B2

(12) United States Patent
Shyn et al.

(10) Patent No.: US 6,568,801 B2
(45) Date of Patent: May 27, 2003

(54) PRESSURE-COMPENSATION DEVICE

(75) Inventors: Der-Rong Shyn, Putz (TW); Chih-Ching Chen, Taipei (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 10/001,823

(22) Filed: Dec. 5, 2001

(65) Prior Publication Data

US 2002/0067398 A1 Jun. 6, 2002

(30) Foreign Application Priority Data

Dec. 5, 2000 (TW) ..... 89125934 A

(51) Int. Cl.[7] ..... B41J 2/175
(52) U.S. Cl. ..... 347/86; 347/87
(58) Field of Search ..... 347/84, 85, 86, 347/87; 222/386.5

(56) References Cited

U.S. PATENT DOCUMENTS 5,988,803 A * 11/1999 Komplin et al. ..... 347/86
6,186,620 B1 * 2/2001 Hsieh et al. ..... 347/84
6,203,146 B1 * 3/2001 Pawlowksi, Jr. et al. ..... 347/85
6,293,666 B1 * 9/2001 Mou et al. ..... 347/87
6,367,666 B1 * 4/2002 Hou et al. ..... 222/386.5
6,428,153 B1 * 8/2002 Hsu et al. ..... 347/85
6,494,568 B2 * 12/2002 Hou et al. ..... 347/86

* cited by examiner

*Primary Examiner*—Anh T.N. Vo
(74) *Attorney, Agent, or Firm*—Troxell Law Office PLLC

(57) ABSTRACT

A pressure-compensation device for adjusting the backpressure inside the cartridge of an ink jet printer includes an accumulator bag, a resilient element, and a motion element. The accumulator bag, installed inside the cartridge, communicates with the external atmosphere through an air duct. The resilient element, kept at a tension state, has a first end connected with the accumulator bag and a second end connected with the motion element. The resilient element restrains the inflation of the accumulator bag so as to induce a backpressure inside the cartridge. The accumulator bag, gradually inflating along with consumption of the ink inside the cartridge, can move the resilient element and the motion element downwards to keep the resilient element at a stable tension state, and thereby a stable backpressure inside the cartridge can be provided.

17 Claims, 7 Drawing Sheets

PRESSURE-COMPENSATION DEVICE

BACKGROUND OF THE INVENTION (1) Field of the Invention

The present invention relates to a pressure-compensation device, and more particularly to an interior pressure-compensation device for cartridges that can stabilize the internal backpressure of the cartridge for ink jet printers.

(2) Description of the Prior Art

In the computer industry, an ink jet printer, one of the well-known computer peripheral devices, performs printing jobs by providing ink drops from a cartridge through a print head onto a piece of paper or other recording media.

In the art, a well-designed cartridge for ink-jet printer should comply with the following two requirements:

1. While the cartridge is at an idle state, the internal pressure Pi of cartridge should be less than the external atmosphere pressure Po to prevent the cartridge from ink leakage through the print head.
2. While the cartridge is at a printing state, an additional pressure needs to be provided to increase the internal pressure Pi of the cartridge to overcome the external atmosphere pressure Po so that the ink inside the cartridge is able to drop out through the print head and accomplish the intended printing job.

To satisfy the aforesaid first requirement, a resort in the art is to add a backpressure Pb into the cartridge to provide a minus pressure for reducing the internal pressure Pi. By maintaining the internal pressure Pi of the cartridge to be less than the external atmosphere pressure Po during cartridge's idle state, the possible ink leakage from the print head can be prevented.

On the other hand, to satisfy the aforesaid second requirement, a resolution in the art is to utilize a specific print head of thermal bubble type or piezoelectric pressure wave type, which is able to generate a proper print pressure P inside the cartridge during printing. When the printing pressure P is greater than the backpressure Pb, the internal pressure of cartridge Pi reaches a pressure level higher than the external atmosphere pressure Po so that the cartridge allows ink to drop out through the print head to perform the intended printing function. The art of print head is not within the scope of the present invention, therefore, no more efforts thereinafter will be devoted to it.

It is understood that the atmosphere pressure Po varies along with the ambient. For example, the atmosphere pressure Po in a flying airplane or at a location of higher elevation is always smaller than the atmosphere pressure on the ground, so it is not unusual at some locations that the internal pressure Pi of cartridge will be greater than the atmosphere pressure Po, which causes ink to drop out from the cartridge through the print head even when no printing job is at work.

In addition, the backpressure Pb inside the cartridge increases along with the gradual exhaustion of the ink. Therefore, when the backpressure Pb is greater than the print pressure P of print head, the printing job is unable to proceed and the cartridge needs to be replaced even though there is still some ink left in the cartridge.

To resolve the aforesaid disadvantages of the cartridge, a pressure-sensitive accumulator for ink-jet pens disclosed in a U.S. Pat. No. 5,409,134 introduces a device for adjusting backpressure Pb inside the cartridge by maintaining the internal pressure Pi lower than the atmosphere pressure Po within a proper range, so the aforesaid ink leakage and residual ink problems may be successfully avoided. The technique provided in the U.S. patent will be briefly stated as follows.

Referring to FIG. 1A and FIG. 1B, two states of a traditional cartridge 1 with the pressure-sensitive accumulator 10 of U.S. Pat. No. 5,409,134 are shown, respectively. The pressure-sensitive accumulator 10 includes a spring 12 and an accumulator bag 14. The spring 12 further includes a fitment 121, anchoring the spring 12 to a top portion inside the cartridge 1, and two spring legs 122, positioned at opposing ends of the fitment 121. The accumulator bag 14, an inflatable bag structure, further includes an air duct 143, a ventilating means to the atmosphere, and two opposing sides 141 and 142, connected at both ends to form a bag structure. The outer side 141 is attached to the spring leg 122.

While completing the cartridge 1, instead of completely filled with ink, a small interior space inside of the cartridge is left to allow exterior air to flow into the accumulator bag 14 through the air duct 143. Upon the air expanding the accumulator bag 14 inside the cartridge 1, the spring legs 122 of the spring 12 will be bent to a shape as shown in FIG. 1B. The resilience provided by the deformed spring legs 122 will restrain the expansion of the accumulator bag 14 and induce a backpressure Pb to the interior of the cartridge 1. The induced backpressure Pb will then contribute to the internal pressure Pi to be less than the external atmosphere pressure Po. The air duct 143 connects the external atmosphere with the interior of the accumulator bag 14, keeping the internal pressure Pi of the cartridge 1 less than the external atmosphere pressure Po, so no ink leakage occurs even when the cartridge 1 is brought to a higher elevation or inside a flying airplane.

As the ink inside the cartridge 1 runs off gradually, the accumulator bag 14 of the pressure-sensitive accumulator 10 is increasingly inflated, as shown in FIG. 1B, which deforms the spring legs 122 further to produce more backpressure Pb in the interior of the cartridge 1 to prevent the possible ink leakage.

Nevertheless, the aforesaid pressure-sensitive accumulator 10 does exist some practical disadvantages related to the spring legs 122. Since the backpressure Pb increases along with the deformation of the spring legs 122, as the printing job proceeds, ink continuously drops through the print head from the cartridge 1 until the backpressure Pb inside the cartridge 1 is greater than the print pressure provided by the print head (not shown in figures). The dropping of ink is then ceased even when there is still some ink left in the cartridge 1. It is clear that this disadvantage will lead to the waste of ink.

SUMMARY OF THE INVENTION

Accordingly, it is a primary object of the present invention to provide a pressure-compensation device that can adjust the backpressure inside the cartridge within a proper range to assure the normal operation of printing and prevent from possible ink leakage.

It is another object of the present invention to provide a pressure-compensation device for a cartridge, which can stabilize the backpressure inside the cartridge to assure that the printing proceeds smoothly till ink inside the cartridge runs out completely.

The pressure-compensation device of the present invention is designed for the cartridge of ink-jet printer. The cartridge is a sealed container whose internal space accommodates a substantial amount of ink. The pressure-compensation device includes an accumulator bag, a resilient element, and a motion element. A tension spring will be used as an embodiment for the resilient element in the following description.

Inside of the cartridge, formed as a sealed space, is used for storing ink. The accumulator bag is installed inside of the cartridge at a position on top of the stored ink, and the bag interior communicates with the external atmosphere through an air duct. While the ink inside the cartridge is gradually running off, external air is led into the interior of the accumulator bag through the air duct so as to inflate and thus extend the accumulator bag downwards.

The tension spring includes a first end engaged with the bottom end of the accumulator bag, and a second end engaged with the motion element, in which the tension spring is always kept at a tension state. The resilience provided by the elongated tension spring acts against the inflation of the accumulator bag so as to induce a proper backpressure inside the cartridge, in which the backpressure assures the interior pressure of the cartridge to be less than the external atmosphere pressure, thus, to prevent from possible ink leakage.

As the ink inside the cartridge gradually runs off along with the progression of printing work, the external air automatically feeds through the air duct and inflates the accumulator bag. Once the inflating force of the accumulator bag is able to overcome the maximum static friction of the motion element, it can move the tension spring and motion element downwards and thus maintain the backpressure inside the cartridge within a proper range, so that the ink leakage due to the lack of backpressure or the failure to drop ink due to over-backpressure can be avoided.

The motion element of the first embodiment in accordance with the present invention is designed similarly to a piston structure, which includes a piston bar and a penetration hole at the cartridge for the piston bar to penetrate therethrough. The piston bar, connected with the second end of the tension spring, must overcome the maximum static friction against the penetration hole before sliding can be triggered in between. The accumulator bag is gradually inflated along with the consumption of the ink inside the cartridge. Once the inflating force of the accumulator bag is able to overcome the maximum static friction between the piston bar and the penetration hole, the bottom portion of the accumulator bag can drag the tension spring and the motion element downwards to prevent from possible instability of the backpressure inside the cartridge caused by over tensioning the tension spring. Upon such an arrangement, the present invention is then able to prevent from the possible ink leakage during the idle state and to assure the success of ink dropping through the print head during printing.

The design of the motion element of the second embodiment in accordance with the present invention is similar to that of the first embodiment, whereof the major difference is that the tension spring and the motion element of the second embodiment are located inside the accumulator bag and are used to move with the bottom of the accumulator bag so as to maintain a stable backpressure inside the cartridge while the ink is gradually running off.

The motion element of the third embodiment in accordance with the present invention is formed by a plurality of pulley sets, preferably by a pair of parallel pulley set. Each of the pulley sets includes two fixed pulleys and a rope, whereof the two fixed pulleys are located separately at the top and at the bottom inside of the cartridge and the rope is wound around the two fixed pulleys. At least one fixed pulley of the pulley sets includes a torque limiter for providing a minimum forcing limit to rotate the pulley sets.

Both ropes of the aforesaid two pulley sets are connected with the second end of the tension spring that, as stated above, is kept at a tension state. The resilience of the tension spring restrains the inflation of the accumulator bag so as to maintain a proper backpressure inside the cartridge. As the accumulator bag is gradually inflated along with the consumption of the ink, the accumulator bag may move the tension spring and the rope downwards to maintain the backpressure inside the cartridge within a proper range to prevent from the ink leakage due to the lack of backpressure or the fail of ink dropping due to over-backpressure.

The design of the motion element of the fourth embodiment in accordance with the present invention is similar to that of the third embodiment, whereof the major difference is that the tension spring of the fourth embodiment is located at the bottom of the cartridge and is kept at a tension state. The resilience provided by the tension spring restrains the inflation of the accumulator bag so as to maintain a proper backpressure inside the cartridge. As gradual consumption of the ink, the motion element and the tension spring are moved by the inflated accumulator bag to maintain the deformation of the tension spring at a stable state and thus prevent the instability of backpressure inside the cartridge, by which possible ink leakage due to the lack of backpressure or the fail of ink dropping due to over-backpressure can be avoided.

As the accumulator bag is gradually inflated along with the consumption of the ink, when the inflation overcomes the torque limit of the toque limiter, the accumulator bag can move the tension spring and the rope downwards to maintain the backpressure inside the cartridge within a proper range, so that disadvantages of the ink leakage or the fail of ink dropping can be waived.

BRIEF DESCRIPTION OF THE DRAWINGS

The present invention will now be specified with reference to its preferred embodiments illustrated in the drawings, in which.

DESCRIPTION OF THE PREFERRED EMBODIMENT

The invention disclosed herein is directed to a pressure-compensation device. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1A:
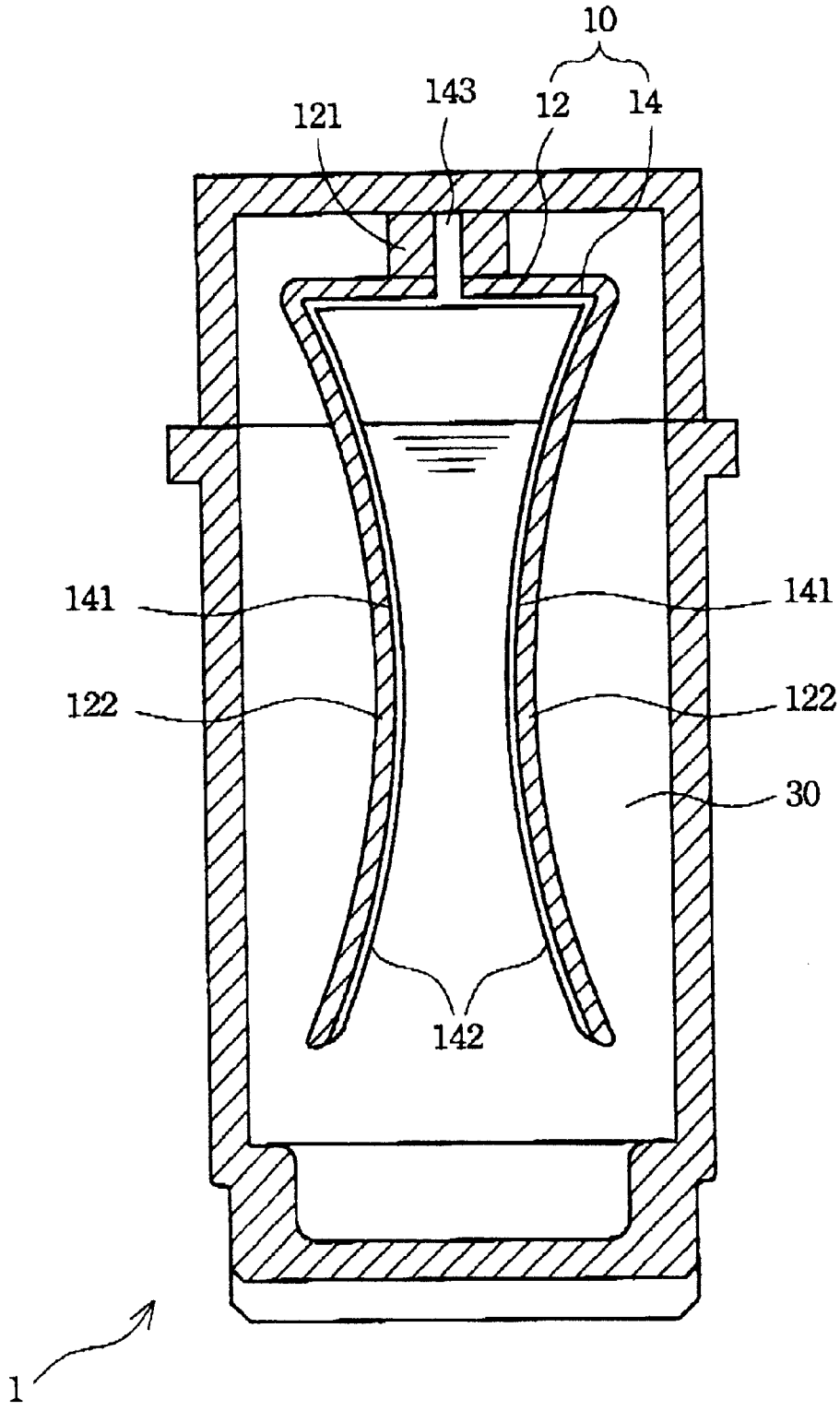
FIG. 1A (PRIOR ART)
FIG. 1A is a schematic cross-sectional view of a prior pressure-sensitive accumulator inside a cartridge at an un-inflation state.
Figure 1B:
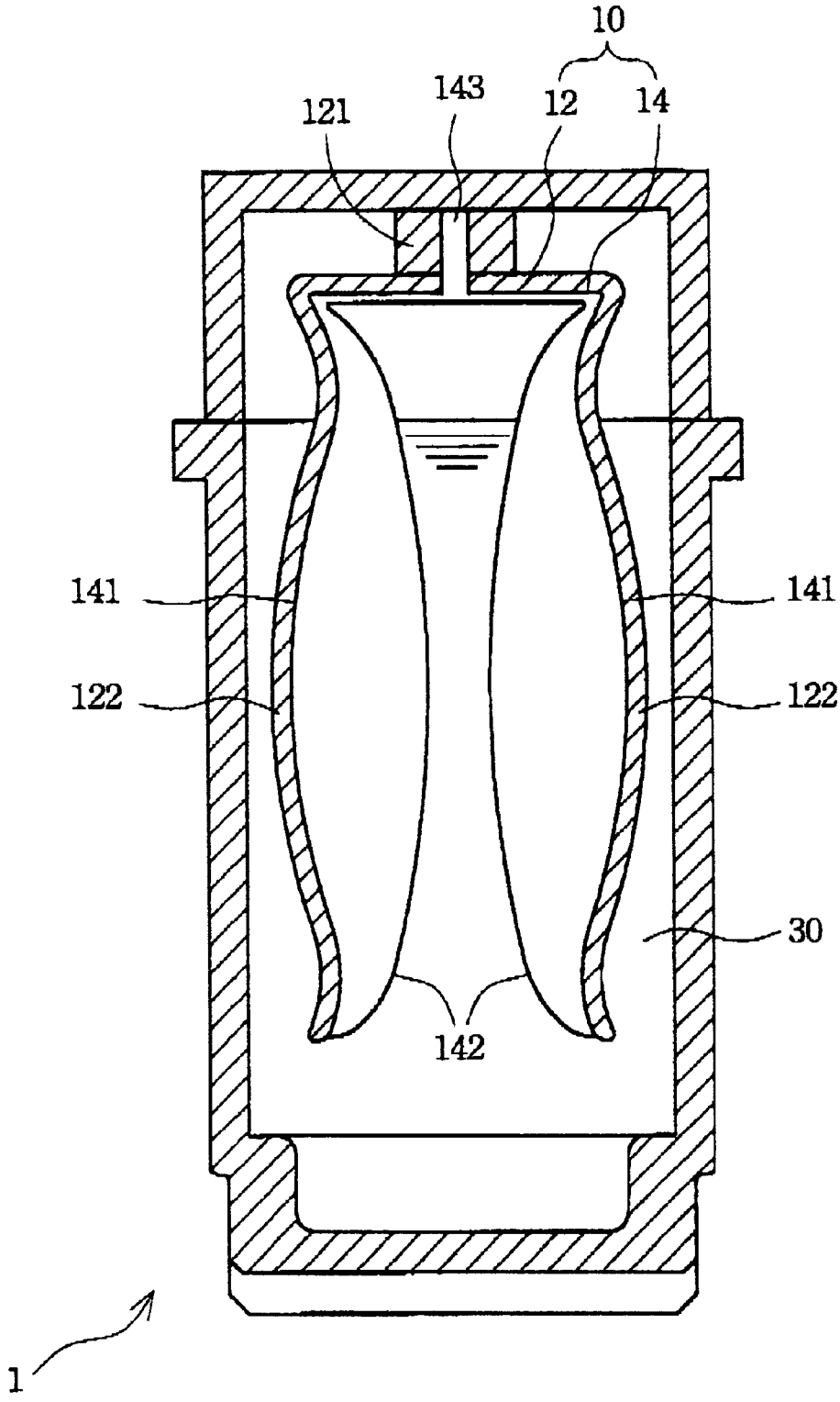
FIG. 1B (PRIOR ART)
FIG. 1B is a schematic cross-sectional view of the prior pressure-sensitive accumulator of FIG. 1A at an inflation state.
Figure 2B:
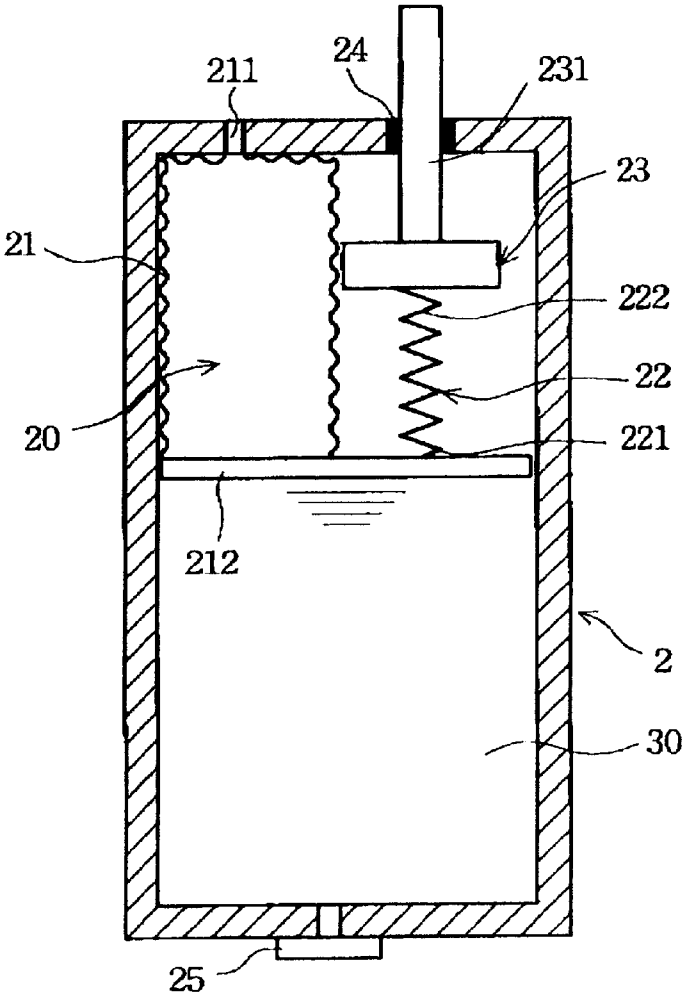
FIG. 2B is a schematic side cross-sectional view of the first embodiment of FIG. 2A.
Figure 2A:
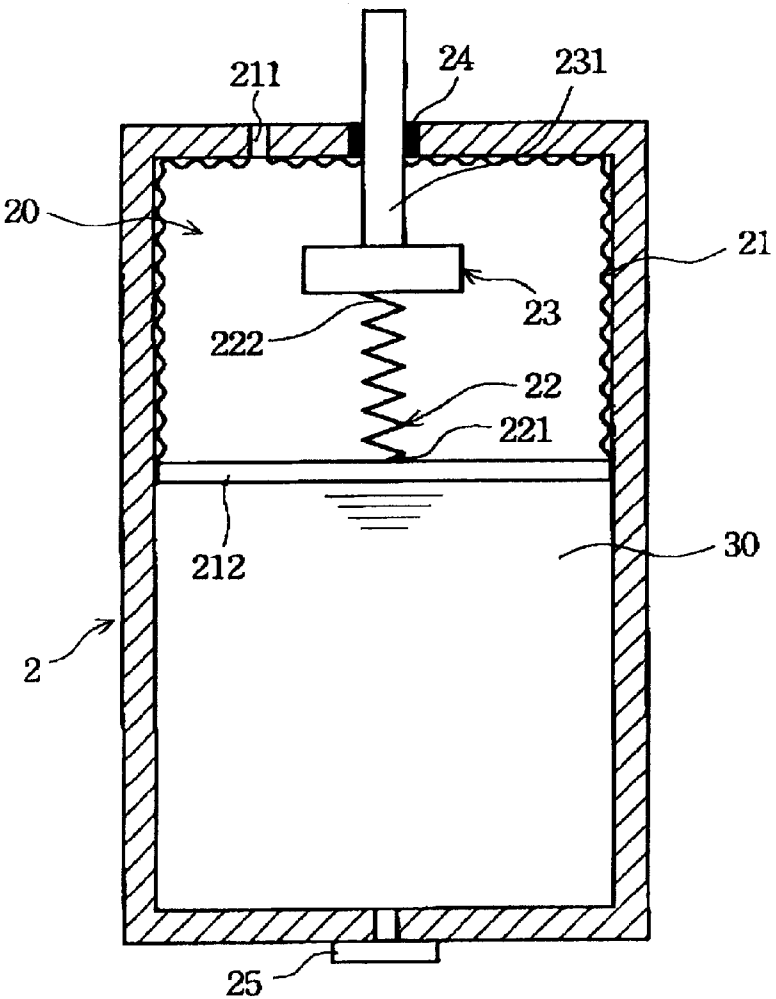
FIG. 2A is a schematic front cross-sectional view of a first embodiment of the pressure-compensation device in accordance with the present invention.

Referring now to FIG. 2A and FIG. 2B, two different views of a first embodiment of the pressure-compensation device in accordance with the present invention are shown, respectively. The pressure-compensation device 20 is used to adjust the backpressure inside a cartridge 2. The cartridge 2, formed as a sealed container, provides an internal space to accommodate a substantial amount of ink 30. The pressure-compensation device 20 includes an accumulator bag 21, a tension spring 22, and a motion element 23.

The accumulator bag 21 as shown is installed inside the cartridge 2 and can communicate with the atmosphere through an air duct 211 thereof. As the ink 30 inside the cartridge 2 gradually runs off, the external air can be automatically drawn through the air duct 211 and inflate the accumulator bag 21. The bottom of the accumulator bag 21 is connected with a disk 212 that can move up and down along with the inflation or deflation of the accumulator bag 21.

Figure 3:
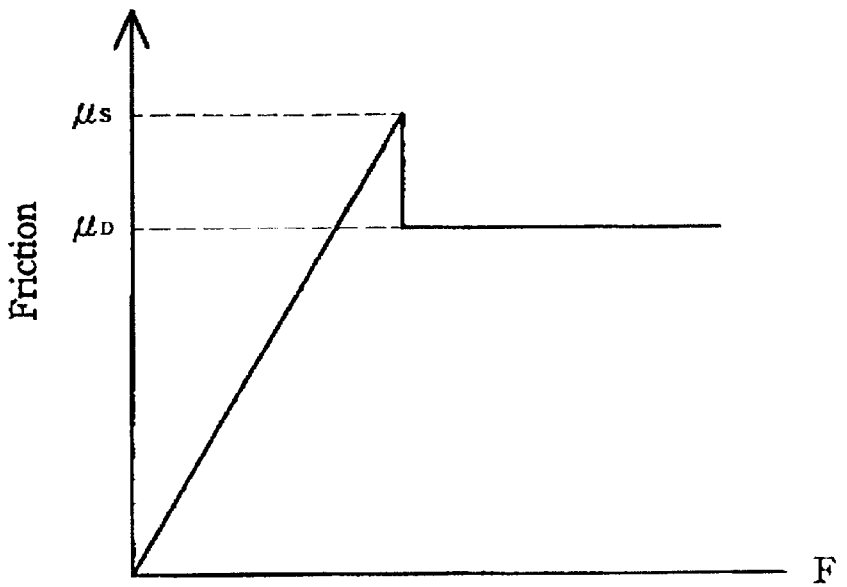
FIG. 3 is a schematic figure of the friction varying between the piston bar and the penetration hole of the first embodiment in accordance with the present invention.

The tension spring 22 and the motion element 23 are located inside the cartridge 2 but outside of the accumulator bag 21 (as shown in FIG. 2B). The motion element 23 is similar to a piston structure, which can include a piston bar 231 and a penetration hole 24. The penetration hole 24 is located at the cartridge 2 for allowing the piston bar 231 to penetrate through and to slide along. As shown, the piston bar 231 mates with the penetration hole 24 having an internal surface coated with a friction material. Practically, the piston bar 231 has to overcome the maximum static friction between the piston bar 231 and the internal surface of the penetration hole 24 in order to slide along the penetration hole 24 (as shown in FIG. 3).

Referring to FIG. 2A and FIG. 2B, the first end 221 of the tension spring 22 is connected with the disc 212 located beneath the accumulator bag 21, and the second end 222 of the tension spring 22 is connected with the motion element 23. The tension spring 22 is kept at a tension state for providing required resilience to restrain the inflation of the accumulator bag 21 and thus to induce a proper backpressure Pb inside the cartridge 2. The accumulator bag 21 can communicate with the atmosphere through the air duct 211. Therefore, no matter when the cartridge 2 is used in a flying plane or at a higher elevation, the backpressure Pb can assure that the pressure Pi inside the cartridge 2 is less than the atmosphere pressure Po, so that possible ink leakage from the cartridge 2 through the print head 25 can be avoided.

As the ink inside the cartridge 2 decreases along with the ink consumption, the accumulator bag 21 is gradually inflated by drawing air from the atmosphere. When the inflation force is greater than the maximum static friction between the piston bar 231 and the penetration hole 24, the disk 212 beneath the accumulator bag 21 can push the tension spring 22 and the motion element 23 downwards. Upon such an arrangement, the deformation of the tension spring 22 can be maintained within a suitable range, and thus the variation of the internal backpressure Pb inside the cartridge 2 can be properly controlled so as to waive the possibility of ink leakage by an insufficient backpressure Pb or fail of ink dropping by an over-backpressure Pb.

Figure 4B:
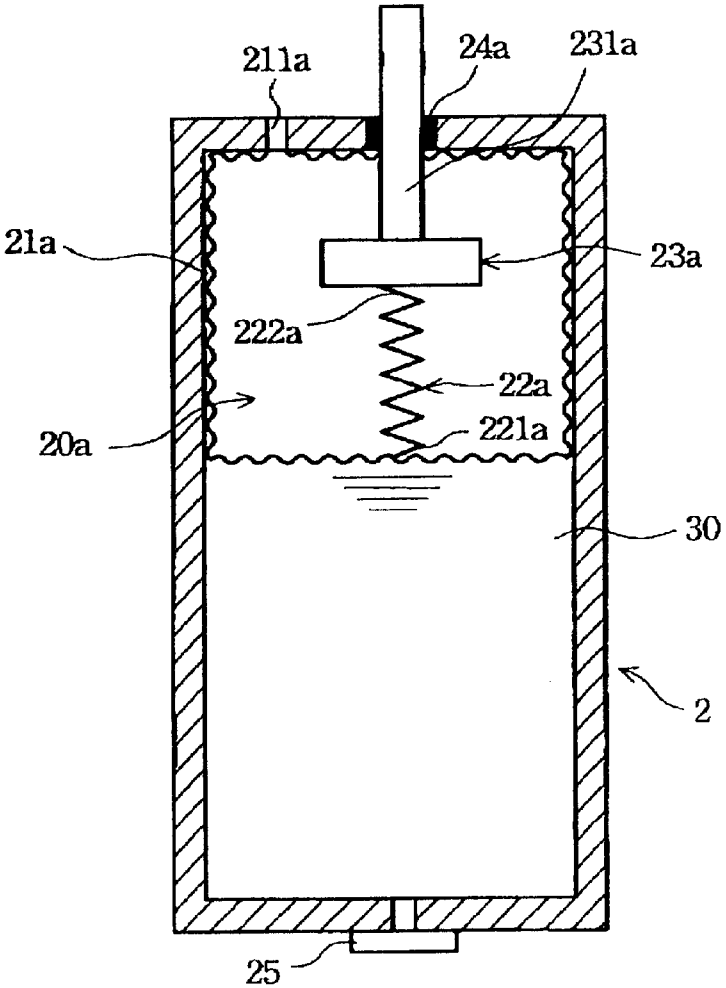
FIG. 4B is a schematic side cross-sectional view of the second embodiment of FIG. 4A.
Figure 4A:
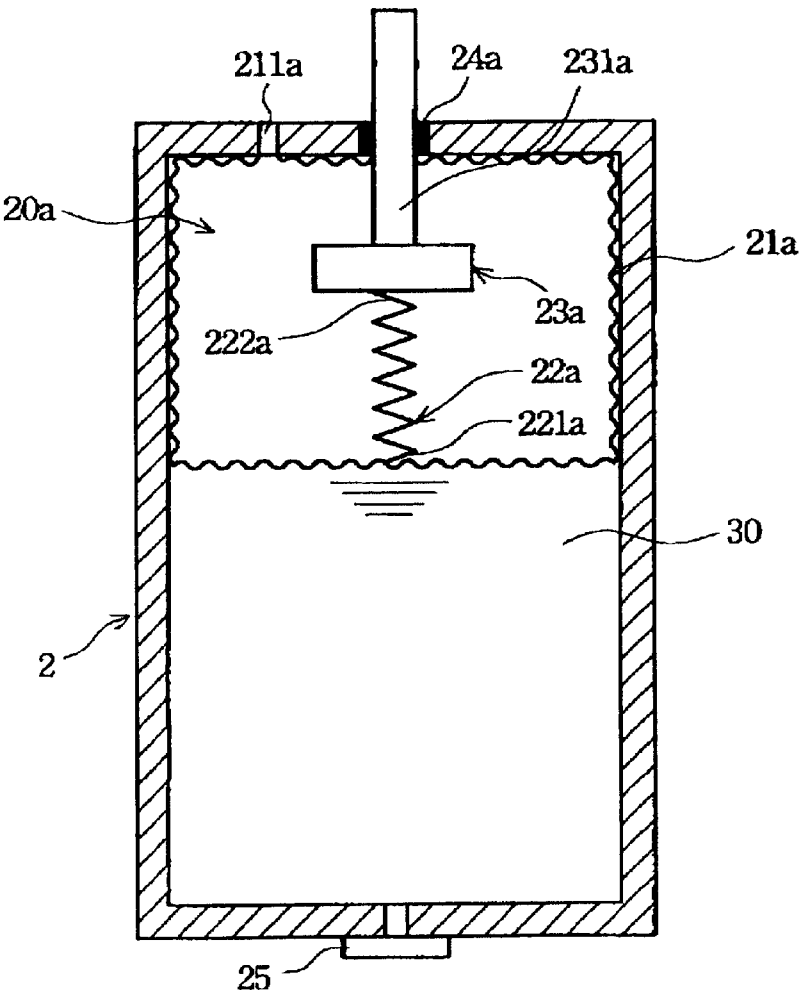
FIG. 4A is a schematic front cross-sectional view of a second embodiment of the pressure-compensation device in accordance with the present invention.

Please refer to FIG. 4A and FIG. 4B, showing a second embodiment of the pressure-compensation device 20 in accordance with the present invention at two sides' views. Most elements of the second embodiment are similar both in function and in structure to those of the first embodiment. Therefore, to simplify the description, common elements are given the same numerical orders and won't be discussed further, while the elements performing the same function but with different structural designs are given the same numerical order but suffixed by an "a" for distinguishing.

Major difference between the first embodiment and the second embodiment is that the tension spring 22*a* and the motion element 23*a* of the second embodiment are located inside the accumulator bag 21*a*. The first end of the tension spring 221*a* is connected directly with the bottom of the accumulator bag 21*a*, while the disk 212 beneath the accumulator bag 21 as shown in FIG. 2A and FIG. 2B is removed. The operation of this embodiment is the same as the first one and won't be discussed further.

Figure 5B:
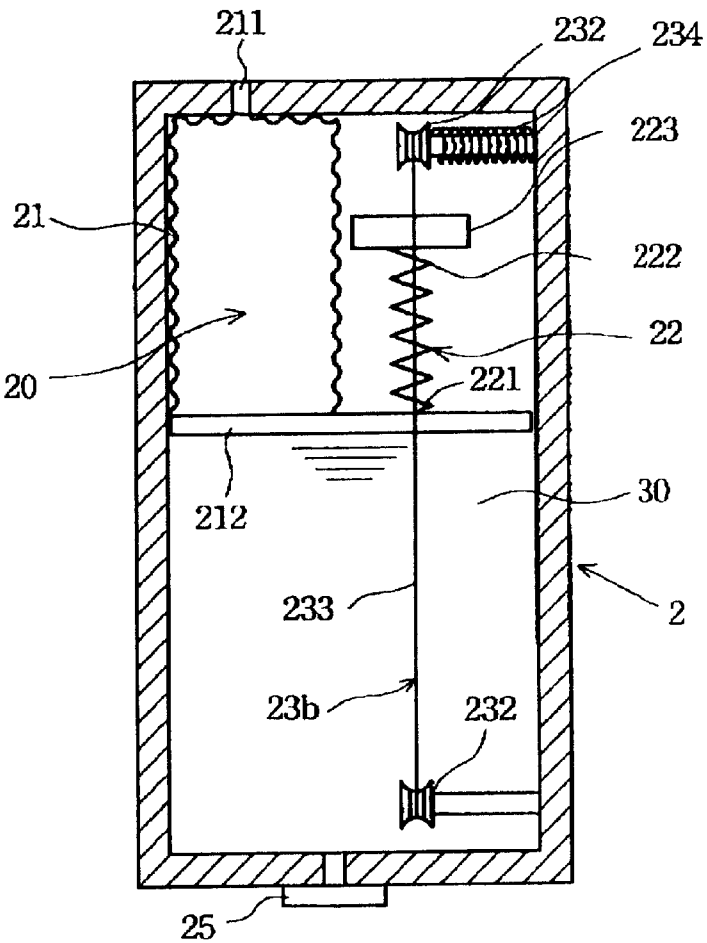
FIG. 5B is a schematic side cross-sectional view of the third embodiment of the pressure-compensation device of FIG. 5A.
Figure 5A:
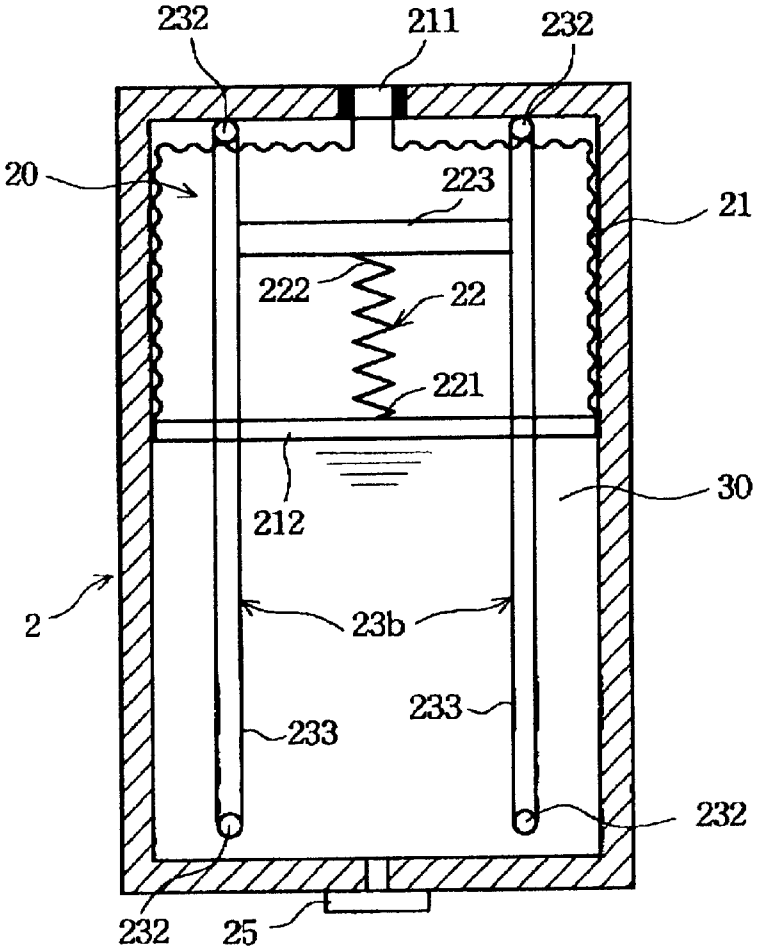
FIG. 5A is a schematic front cross-sectional view of a third embodiment of the pressure-compensation device in accordance with the present invention.

Please refer to FIG. 5A and FIG. 5B, showing a third embodiment of the pressure-compensation device in accordance with the present invention at two sides' cross-sectional views. Most elements of the third embodiment are similar both in function and in design to those of the first embodiment, so the common elements are given the same numerical orders and won't be discussed further, while the elements performing the same function but with different structural designs are given the same numerical orders with a suffix "b".

In the third embodiment according to the present invention, the motion element 23*b* can be formed by even pulley sets, preferably four pulley sets or two pulley sets as shown. The two pulley sets are located separately on the opposite sides inside of the cartridge 2, whereof each pulley set can include two fixed pulleys 232 located respectively at the top and the bottom of the cartridge at the same side, and a rope 233 wound around the two fixed pulleys 232. Preferably, at least one fixed pulley 232 of the pulley sets may have a torque limiter 234, by which the fixed pulley 232 need to overcome the torque limit of the torque limiter 234 for the rotation to start.

The two pulley sets utilize the individual ropes 233 to connect with opposing ends of a disk 223 located at top of the second end 222 of the tension spring 22. Being tensioned by the two ropes 233 and the disk 223, the tension spring 22 can thus provide the required resilience to restrain the inflation of the accumulator bag 21 and further to induce a proper backpressure Pb inside the cartridge 2. The backpressure Pb as stated above can be used to assure the internal pressure Pi to be less than the atmosphere Po for preventing from the ink leakage from the cartridge 2 through the print head 25.

Figure 6B:
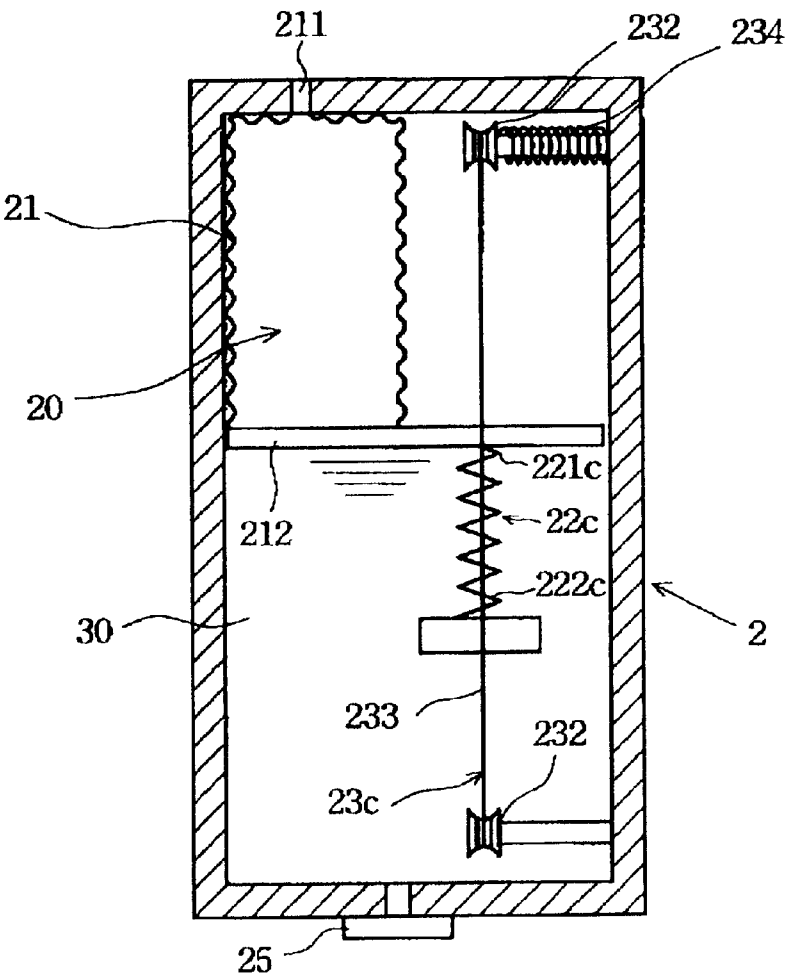
FIG. 6B is a schematic side cross-sectional view of the fourth embodiment of the pressure-compensation device of FIG. 6A.
Figure 6A:
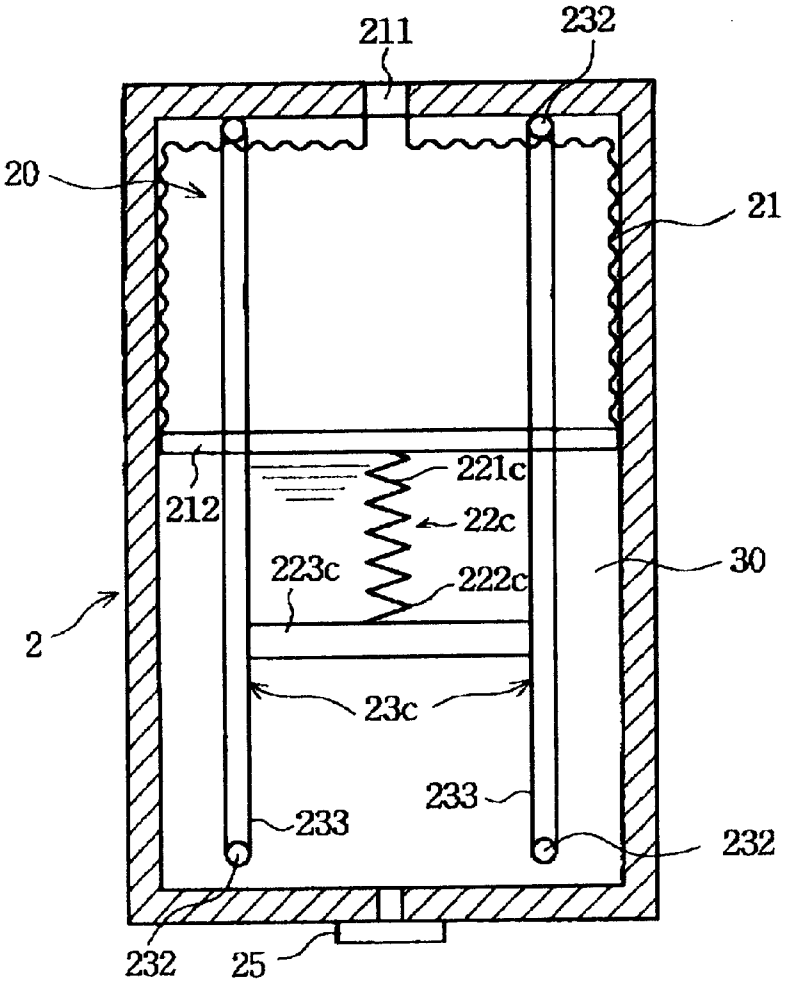
FIG. 6A is a schematic front cross-sectional view of a fourth embodiment of the pressure-compensation device in accordance with the present invention.

Please refer to FIG. 6A and FIG. 6B, showing a fourth embodiment of the pressure-compensation device in accordance with the present invention. Most elements of the fourth embodiment are similar both in function and in design to those of the third embodiment, so the common elements will be given the same numerical orders and won't be discussed further, while the elements performing the same function but with different structural designs are given the same numerical orders with a suffix "c".

The motion element 23*c* of the embodiment is similar to the one of the third embodiment in design, whereof the major difference is that the compression spring 22*c* of this embodiment is located at the lower portion of the cartridge 2 and utilizes a disk 223*c* on the second end 222*c* to connect with the two ropes 233*c* of the two pulley sets. The compression spring 22*c* is kept at a compression state so as to provide the required resilience for inducing a proper backpressure Pb inside the cartridge 2 to further assure the internal pressure Pi of the cartridge 2 less than the atmosphere pressure Po, from which the ink leaking from the cartridge 2 through the print head can be prevented.

In this embodiment, the volume of the accumulator bag 21 is gradually expanded along with the consumption of the ink inside the cartridge 2. When the expansion force is greater than the torque limit of the torque limiter 234, the accumulator bag 21 can push the compression spring 22*c* and the rope 23*c* downwards. However, the deformation of the compression spring 22*c* is designed not to be larger enough to severely change the internal backpressure Pb of the cartridge 2, so that the ink leaking from the cartridge 2 due to an under-backpressure Pb or the fail of ink dropping due to an over-backpressure Pb can be avoided.

As described above, the pressure-compensation device in accordance with the present invention has at least the following advantages.

a. The backpressure inside the cartridge can be adjusted within an acceptable range to prevent from the ink leakage problem even upon an occurrence of atmosphere pressure change.

b. The pressure-compensation device in accordance with the present invention is able to assure the stabilization of the backpressure inside the cartridge, so the printing operation is able to proceed smoothly till the complete exhaustion of the ink inside the cartridge.

While the present invention has been particularly shown and described with reference to a preferred embodiment, it will be understood by those skilled in the art that various changes in form and detail may be without departing from the spirit and scope of the present invention.

I claim:

1. A pressure-compensation device, for adjusting an internal pressure of a cartridge whose interior space contains ink therein for use of an ink-jet printer, comprising:

an accumulator bag, installed inside said cartridge, communicating inside thereof with the atmosphere through an air duct;

a resilient element, including thereof a first end and a second end, said first end engaging with said accumulator bag, said resilient element producing a deformation and thereby inducing a backpressure inside said cartridge for acting against an inflation of said accumulator bag; and a motion element, connected with said second end of said resilient element, for contributing to axial movement of said accumulator bag;

wherein, along with gradual decreasing of said ink inside said cartridge, external air being drawn through said air duct inflates said accumulator bag for balancing said internal pressure of said cartridge, and said inflation moves said resilient element and said motion element to maintain stably said internal backpressure inside said cartridge.

2. The pressure-compensation device according to claim 1 further includes a disk located at a bottom end of said accumulator bag and said resilient element for guiding said accumulator bag to deform along an axial direction thereof.

3. The pressure-compensation device according to claim 1, wherein said resilient element is a tension spring.

4. The pressure-compensation device according to claim 1, wherein said motion element has a structure similar to a piston structure with a piston bar moveable along a penetration hole of said cartridge, an internal surface of said penetration hole being padded with a friction material for providing resistance upon said piston bar to act against said inflation of said accumulator bag.

5. The pressure-compensation device according to claim 1, wherein said resilient element and said motion element are located inside said accumulator bag.

6. The pressure-compensation device according to claim 1, wherein said resilient element and said motion element are located outside said accumulator bag.

7. The pressure-compensation device according to claim 1, wherein said motion element includes at least a pulley set which further includes thereof two fixed pulleys attached respectively thereinside to a top and a bottom of said cartridge and a rope wound around said fixed pulleys and connected with said second end of said resilient element, at least one of said fixed pulley including a torque limiter and thereby said inflation of said accumulator bag needed to overcome a torque of said torque limiter so as to move said resilient element and said rope.

8. The pressure-compensation device according to claim 7, wherein said second end of said resilient element includes thereof a disk that is connected with said rope of said pulley set.

9. The pressure-compensation device according to claim 8, wherein location of said disk is always higher than said bottom of said accumulator bag.

10. The pressure-compensation device according to claim 9, wherein said resilient element is a tension spring.

11. The pressure-compensation device according to claim 8, wherein location of said disk is always lower than said bottom of said accumulator bag.

12. The pressure-compensation device according to claim 11, wherein said resilient element is a compression spring.

13. The pressure-compensation device according to claim 1, wherein said motion element includes a parallel pair of pulley sets, each of said pulley set further including thereof two fixed pulleys attached respectively thereinside to a top and a bottom of said cartridge and a rope wound around said fixed pulleys and connected with said second end of said resilient element, at least one of said fixed pulley in said pulley set including a torque limiter and thereby said inflation of said accumulator bag needed to overcome a torque of said torque limiter so as to move said resilient element and said rope.

14. The pressure-compensation device according to claim 1, wherein said motion element includes four parallel pulley sets, each of said pulley set further including thereof two fixed pulleys attached respectively thereinside to a top and a bottom of said cartridge and a rope wound around said fixed pulleys and connected with said second end of said resilient element, at least one of said fixed pulley in said pulley set including a torque limiter and thereby said inflation of said accumulator bag needed to overcome a torque of said torque limiter so as to move said resilient element and said rope.

15. The pressure-compensation device according to claim 1, wherein said motion element further includes a horizontal shaft, a pulley, and a torque limiter, in which said horizontal shaft is located on an inside top of said cartridge, said pulley utilizing said torque limiter to attach onto said horizontal shaft and utilizing a rope to connect with said second end of said resilient element, and said inflation of said accumulator bag needed to overcome a torque of said torque limiter to move said resilient element and said rope.

16. The pressure-compensation device according to claim 15, wherein said second end of said resilient element includes a disk with which said rope is connected.

17. A cartridge for ink jet printer, including ink contained inside said internal space of said cartridge, a print head located on a bottom of said cartridge and a pressure-compensation device for adjusting an internal pressure inside said cartridge while printing, said cartridge comprising:

an accumulator bag, located inside said cartridge and communicating thereofinside with the atmosphere through an air duct thereof;

a resilient element, including thereof a first end and a second end, said first end connected with said accumulator bag and producing a deformation to act against contraction of said accumulator bag so as to induce a backpressure inside said cartridge; and a motion element, connected with said second end of said resilient element for producing movement along an axial direction of said accumulator bag;

wherein, as gradual decreasing of said ink inside said cartridge, said atmosphere air is drawn through said air duct to inflate said accumulator bag for balancing said internal pressure inside said cartridge and further to move said resilient element and said motion element so as to maintain a stable backpressure inside said cartridge.

* * * * *